United States Patent [19]

Clodfelter

[11] 3,961,556

[45] June 8, 1976

[54] ROCKET LAUNCHER TELESCOPING TUBE LOCKING MECHANISM

[75] Inventor: Glen A. Clodfelter, Madison, Ala.

[73] Assignee: The United States of America as represented by the Secretary of the Army, Washington, D.C.

[22] Filed: Oct. 3, 1974

[21] Appl. No.: 511,829

[52] U.S. Cl. ..... 89/1.816; 403/108

[51] Int. Cl.[2] ..... F41F 3/04

[58] Field of Search ..... 89/1.7, 1.8, 1.816, 89/1.817, 1.819, 1.813; 403/108, 109, 377; 285/303, 305

[56] References Cited

UNITED STATES PATENTS

| | | | |
|---|---|---|---|
| 2,850,307 | 9/1958 | Kindl | 403/108 |
| 3,182,553 | 5/1965 | Choate et al. | 89/1.817 |
| 3,208,347 | 9/1965 | Choate | 89/1.816 X |
| 3,371,578 | 3/1968 | Choate et al. | 89/1.816 X |
| 3,698,747 | 10/1972 | Wing et al. | 285/305 |
| 3,745,876 | 7/1973 | Rocha | 89/1.816 X |

*Primary Examiner*—David H. Brown

*Attorney, Agent, or Firm*—Nathan Edelberg; Robert P. Gibson; Charles R. Carter

[57] ABSTRACT

A locking mechanism for a man-transportable anti-tank rocket launcher tube having cooperative mating parts on the inner and outer telescoping launcher tubes. This mechanism prevents the relative longitudinal and rotational movement of the inner tube to the outer tube when the tubes are either in the extended or retracted positions.

3 Claims, 5 Drawing Figures

ROCKET LAUNCHER TELESCOPING TUBE LOCKING MECHANISM

Dedicatory Clause — This invention described herein may be manufactured, used, and licensed by or for the Government for Governmental purposes without the payment to me of any royalties thereon.

BACKGROUND OF THE INVENTION

This invention relates to the field of rocket launchers. In recent years there has been development of extremely lightweight, man portable anti-tank rocket launchers with minimum carry length. These launchers consist of thin-walled telescoping inner and outer tubes, with the telescoping aspect providing a minimum launcher carry length. Normally when the tubes are extended, the outer tube becomes the forward portion of the launcher and the inner tube the aft portion. Under these conditions the inner tube then withstands the greatest share of the rocket exhaust forces and the outer tube acts as a missile exhaust shield. These launchers have sights that are mounted on the outer tube only and a fixed alignment need not be maintained between the inner and outer tubes for sighting purposes. When the launch tubes are reversed wherein the inner tube becomes the forward launch tube and the outer tube becomes the aft tube a problem in sighting arises. One sight is mounted on each tube and some mechanism or device is necessary to hold the tubes against relative longitudinal and rotational movement with respect to each other when in the extended position.

SUMMARY OF THE INVENTION

The present invention has provided a solution to the problem of relative movement of the inner and outer launcher tubes when the inner tube is the forward portion and the outer tube is the aft portion. A locking mechanism serves to fasten these two tubes together in the extended position for a fixed distance between the fore and aft sights for a minimum of weight. This mechanism is also used to lock the tubes in a shortened inoperative position for individual man transportation.

DESCRIPTION OF THE PREFERRED EMBODIMENT

Figure 1:
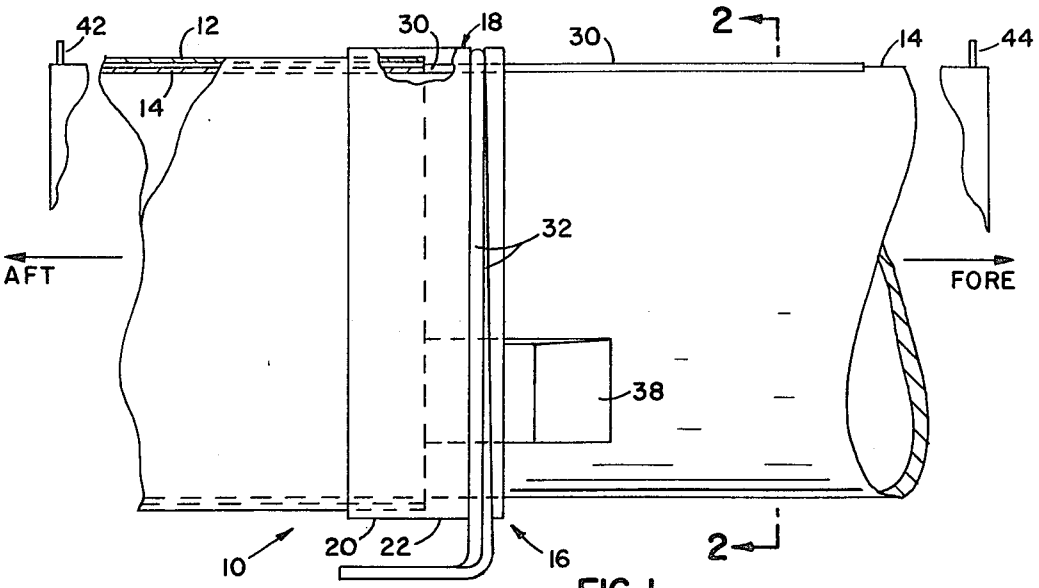
FIG. 1 is an elevation view of the launcher assembly including the lock mechanism for holding the tubes in extended position.

As seen in FIG. 1, a rocket launcher 10 includes a aft outer tube section 12 and an forward inner tube section 14. A locking mechanism assembly 16 is carried by the tube sections for cooperation therebetween to maintain the tubes in extended or retracted positions.

Figure 2:
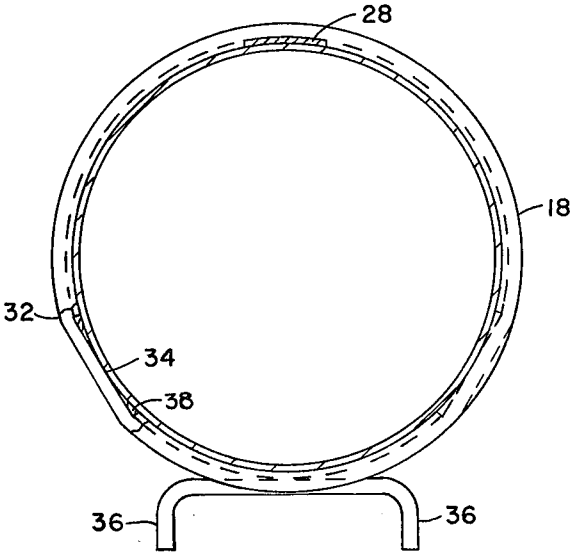
FIG. 2 is a view along line 2—2 of FIG. 1 showing the lock mechanism in engagement with the lock plate.
Figure 5:
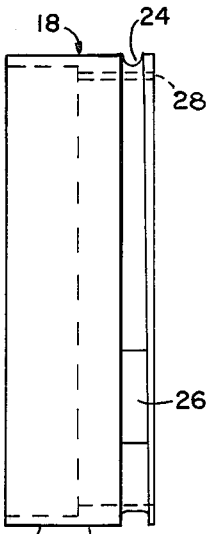
FIG. 5 is a side view of the retainer ring.

As shown in FIG. 1, the aft outer tube section 12 includes a retainer ring 18 secured to the forward end of the section 12. The retainer ring 18 is either bonded by an epoxy adhesive to the tube or mechanically fastened thereto. The retainer ring is provided with perpherial flange 20 for attachment with section 12 and a cylindrical portion 22. As seen in FIG. 5, a groove 24 is provided in cylindrical portion 22 and includes openings 26 provided in the bottom of groove 24. The inner surface of retainer 18 is provided with a arcuate slot 28 for guiding purposes, shown in FIG. 2.

Aft tube section 14 includes a guide 30 in the form of an elongated strip of metal or synthetic material either bonded or mechanically fastened to the top of the inner launch tube 14. This guide mates with the arcuate slot 28 of the retainer ring to fix orientation between the inner and outer launch tubes.

Figure 4:
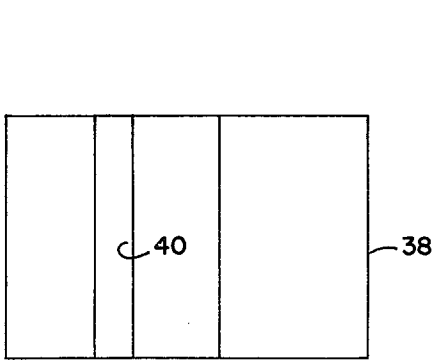
FIG. 4 is a plan view of the lock plate.
Figure 3:
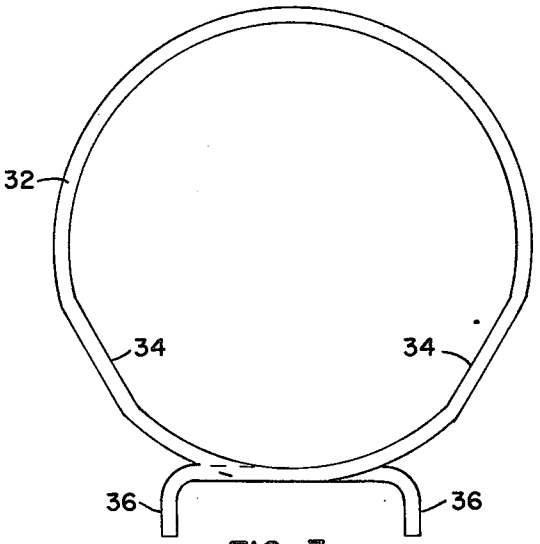
FIG. 3 is a plan view of the lock spring.

The locking mechanism 16 includes a lock spring 32, shown in FIG. 3, which is installed in the groove 24 and includes flattened portions 34 that project through groove openings 26. Tangs 36 are provided on the lock spring for operating the spring to adjust its width. A plurality of lock plates 38 are either bonded or mechanically fastened in position on the inner launch tube 14. These plates, shown in FIG. 4, are provided with a recess 40 for engagement with the flattened section 34 of the lock spring. The lock plates may be installed at opposite ends of the inner launch tube 14, in reversed positions, to hold both the inner and outer launch tube in either the extended or retracted positions by the lock spring. Firing sights 42 and 44 are respectively mounted on the outer tube 12 and inner tube 14.

In operation, the forward inner launch tube 14 is telescoped inside the aft outer tube 12 so that the lock spring is engaged with the lock plates at one end of tube 14. The lock spring tangs 36 are squeezed together to release the lock spring from the lock plate. While holding the lock spring in this released position, the inner tube 14 is extended to an extended forward position. When the lock spring has cleared the lock plates, it is released and the lock spring will engage the opposite end lock plates when the inner tube is fully extended.

I claim:

1. A lightweight man-transportable rocket launcher comprising:

a. inner and outer tubular sections connected to telescope between a shortened, inoperative position and an extended operative position;

b. a first sight mounted on said outer tubular member, and, a second sight mounted on said inner tubular member; and c. a locking mechanism carried by said tubular sections for cooperation therebetween for securing said sections in said extended position, said locking mechanism including a retainer ring secured to the forward end of the outer tubular section and a locking plate secured to said inner tubular section, said retainer ring having an outer cylindrical portion provided with a groove therein, a lock spring disposed in said groove, said groove being provided with openings therethrough whereby during displacement of said tubes to said extended position said lock spring extends through said openings in said groove to engage said locking plate.

2. A rocket launcher as set forth in claim 1 wherein said locking plate is provided with a recess and said lock spring is provided with a flattened portion which engages said recess when the tubes are displaced to the extended position.

3. A rocket launcher as set forth in claim 2 wherein said outer tubular section is provided with a arcuate slot and said inner tubular section includes an elongated guide for mating with said slot to fix orientation between said tubes.

* * * * *